US007925439B2

(12) United States Patent
McCain

(10) Patent No.: US 7,925,439 B2
(45) Date of Patent: Apr. 12, 2011

(54) GIMBALED SATELLITE POSITIONING SYSTEM ANTENNA

(75) Inventor: Steven Daniel McCain, Tracy, CA (US)

(73) Assignee: Topcon Positioning Systems, Inc., Livermore, CA (US)

( * ) Notice: Subject to any disclaimer, the term of this patent is extended or adjusted under 35 U.S.C. 154(b) by 1210 days.

(21) Appl. No.: 11/583,438

(22) Filed: Oct. 19, 2006

(65) Prior Publication Data

US 2008/0097693 A1 Apr. 24, 2008

(51) Int. Cl.
*G01C 21/00* (2006.01)

(52) U.S. Cl. ..... 701/213; 701/207; 701/220

(58) Field of Classification Search ..... 701/50, 701/207, 213, 220; 703/213; 340/990, 995.1, 340/995; 33/355 R, 356–359; 342/355, 342/357, 357.2; 172/2–3; 180/14.5; 324/244–246; 37/347, 411; 244/3.15, 3.2
See application file for complete search history.

(56) References Cited

U.S. PATENT DOCUMENTS

| | | | | |
|---|---|---|---|---|
| 4,396,878 | A * | 8/1983 | Cole et al. | 318/648 |
| 4,608,641 | A * | 8/1986 | Snell | 701/4 |
| 4,829,418 | A | 5/1989 | Nielsen et al. | |
| 4,888,890 | A | 12/1989 | Studebaker et al. | |
| 5,019,761 | A | 5/1991 | Kraft | |
| 5,100,229 | A | 3/1992 | Lundberg et al. | |
| 5,551,524 | A | 9/1996 | Yamamoto et al. | |
| 5,666,792 | A | 9/1997 | Mullins | |
| 5,927,653 | A * | 7/1999 | Mueller et al. | 244/171.3 |
| 6,044,316 | A | 3/2000 | Mullins | |
| 6,112,139 | A | 8/2000 | Schubert et al. | |
| 6,122,595 | A * | 9/2000 | Varley et al. | 701/220 |
| 6,144,343 | A * | 11/2000 | Furuya et al. | 343/713 |
| 6,179,246 | B1 * | 1/2001 | Fisel et al. | 244/3.16 |
| 6,374,147 | B1 | 4/2002 | Rockwood | |
| 6,449,884 | B1 | 9/2002 | Watanabe et al. | |
| 6,532,409 | B1 | 3/2003 | Fujishima et al. | |
| 6,614,361 | B1 | 9/2003 | Kinugawa | |
| 6,691,435 | B1 | 2/2004 | Schultz et al. | |
| 6,782,644 | B2 | 8/2004 | Fujishima et al. | |
| 6,859,727 | B2 * | 2/2005 | Bye et al. | 701/210 |

(Continued)

FOREIGN PATENT DOCUMENTS

EP 1772742 A1 * 4/2007

(Continued)

OTHER PUBLICATIONS

John McVay, et al., "Small Dipole Antenna near Peano High-Impedance Surfaces", IEEE, 2004, pp. 1-4.*

(Continued)

*Primary Examiner* — Cuong H Nguyen
(74) *Attorney, Agent, or Firm* — Wolff & Samson PC

(57) ABSTRACT

A method and apparatus for use with a satellite positioning system wherein the receive elements satellite positioning system receive antennas are maintained in an orientation with respect to the positioning system satellites in a way such that the strongest signals can be received from the greatest number of satellites. According to one embodiment, a housing of a positioning antenna is mounted in a gimbaled fashion onto a vehicle, such as an excavator. Such a gimbaled antenna maintains a horizontal orientation relative to a predetermined axis and, as a result, remains in a position to receive signals from positioning system satellites even during instances of high angular deflection of the antenna support, such as may occur during earth-moving operations.

11 Claims, 7 Drawing Sheets

U.S. PATENT DOCUMENTS

| | | | | |
|---|---|---|---|---|
| 6,863,244 | B2 * | 3/2005 | Fowell et al. | 244/171 |
| 7,146,740 | B2 * | 12/2006 | Manfred | 33/356 |
| 7,409,292 | B2 * | 8/2008 | Eckert et al. | 701/220 |
| 2003/0036817 | A1 | 2/2003 | Morley et al. | |
| 2007/0120756 | A1 * | 5/2007 | Ogino et al. | 343/713 |
| 2007/0288165 | A1 * | 12/2007 | Eckert et al. | 701/220 |
| 2008/0012750 | A1 * | 1/2008 | Austin et al. | 342/52 |
| 2008/0097693 | A1 * | 4/2008 | McCain | 701/213 |

FOREIGN PATENT DOCUMENTS

| | | | | |
|---|---|---|---|---|
| JP | 06232615 | A | * | 8/1994 |
| JP | 09061510 | A | * | 3/1997 |
| JP | 9-097404 | | * | 4/1997 |
| JP | 2001356170 | A | * | 12/2001 |
| JP | 2002146829 | A | * | 5/2002 |
| JP | 2005-342891 | | * | 11/2005 |
| JP | 2006060459 | A | * | 3/2006 |
| JP | 2006-126652 | | * | 4/2006 |
| JP | 2007-050759 | | * | 2/2007 |
| WO | WO 2010052558 | A2 | * | 5/2010 |

OTHER PUBLICATIONS

Jinhui Zhu, et al., "Mutual Coupling Effects in Space-Filling-Curve Antennas", IEEE, 2003, pp. 1-2.*

Tier II Plus airborne EO sensor LOS control and image geolocation; Held, K.J.; Robinson, B.H.; Aerospace Conference, 1997. Proceedings., IEEE; vol. 2, Digital Object Identifier: 10.1109/AERO.1997.577989; Publication Year: 1997 , pp. 377-405 vol. 2.*

A Precise Pointing Technique for Free Space Optical Networking; Shim, Yohan; Milner, Stuart D.; Davis, Christopher C.; Military Communications Conference, 2007. MILCOM 2007. IEEE; Digital Object Identifier: 10.1109/MILCOM.2007.4454831 Publication Year: 2007 , pp. 1-7.*

Multiple targets geolocation using SIFT and stereo vision on airborne video sequences; Han, K.; DeSouza, G.N.; Intelligent Robots and Systems, 2009. IROS 2009. IEEE/RSJ International Conference on ; Digital Object Identifier: 10.1109/IROS.2009.5354038; Publication Year: 2009 , pp. 5327-5332.*

Instataneous geo-location of multiple targets from monocular airborne video; Han, K.; DeSouza, G.N.; Geoscience and Remote Sensing Symposium,2009 IEEE International,IGARSS 2009; vol. 4; Digital Object Identifier: 10.1109/IGARSS.2009.5417549; Publication Year: 2009 , pp. IV-1003-IV-1006.*

Technical Notes: SiteVision Automatic Grade Control System, Trimble Navigation Limited, downloaded from http://tri.trimble.com/docushare/dsweb/Get/Documents-9160/SiteVision TN.pdf on Jan. 21, 2005.

* cited by examiner

GIMBALED SATELLITE POSITIONING SYSTEM ANTENNA

BACKGROUND OF THE INVENTION

The present invention relates generally to satellite positioning systems and, more particularly, to antennas used with satellite positioning systems.

Various methods for machine control using position information from satellite positioning systems, such as the Global Positioning System (GPS), are known. In such methods, one or more satellite positioning system antennas are typically disposed on a vehicle, such as an earth-moving machine. Then the position of the antennas is determined using well-known positioning techniques in order to determine and control the positioning of the vehicle or various components of the vehicle, such as the various components of an earthmoving machine that are used in earthmoving operations. For example, FIG. 1 shows one such one such earthmoving machine, an excavator, which is well known in the art. As shown in FIG. 1, excavators such as excavator 100 typically have a main body 101 with a vehicle operator cab 102. Attached to the main body 101 is arm 103, commonly referred to as a "boom". Boom 103 is, in turn, attached to a second arm 104, commonly referred to as a "stick." Stick 104 may be adapted to hold different attachments. Here, stick 104 is attached, illustratively, to a bucket 105 for use in excavation/digging. Bucket 105 typically has prongs 106 attached to the leading edge of the bucket 105 that are used to break through ground and other materials to be excavated. Body 101 is attached to a base which is supported by, illustratively, tracks 107 that allow the excavator to move over a variety of surfaces. One skilled in the art will recognize that other bases have also been designed to be fixed in a single location and, therefore, have no tracks. Alternatively, some bases have been designed with wheels (instead of tracks) which may be desirable in different applications. Regardless the type of base, body 101 is typically attached to the base in a way such that body 101 is capable of rotating 360 degrees while the base remains stationary. Thus, the boom, stick and bucket are movable for digging or other purposes to all points around the base within a certain radius. One skilled in the art will recognize the bucket 105 may be moved with a high degree of flexibility within that given radius. For example, boom 103 may be raised or lowered by lengthening or shortening hydraulic pistons 108, respectively. Similarly, stick 104 may be rotated about pivot point 109 to raise or lower bucket 105 by shortening or lengthening hydraulic piston 110, respectively. Finally, bucket 105 may be rotated about pivot point 111 into a cupped or an open position by either lengthening or shortening hydraulic piston 112.

Excavators, such as excavator 101 in FIG. 1, are useful for many applications. For example, excavators may be used in the digging of trenches, holes and foundations; demolition; general grading and landscaping; heavy lifting (e.g., lifting and placing pipes); river dredging; etc. Initially, the operation of such excavators was performed by skilled operators in conjunction with a ground crew, for example a crew of workers equipped with surveying instruments to ensure, for example, the correct dimensions of an illustrative foundation in the ground. This mode of operation continues to be in widespread use today. However, this mode of operation is time consuming and labor intensive.

In order to decrease the time and cost associated with earthmoving operations, there have been various attempts at automating the operation of excavators and other earthmoving machines. For example, in one method disclosed in U.S. Pat. No. 6,782,644 to Fujishima et al., a satellite-based navigation system, such as the well-known Global Positioning System (GPS) or the Global Orbiting Navigation Satellite System (GLONASS), is used to control an excavator by remote control. Other similar systems have also been used to precisely monitor the movement of excavators during earthmoving operations.

FIG. 2 shows a prior art excavator using satellite positioning to increase excavation accuracy. Specifically, antennas 201 and 202 are mounted on body 101 of excavator 100. Using well known positioning techniques, the location of each antenna may be ascertained with a predetermined level of accuracy. The highest accuracy may typically be achieved with differential or real time kinematic (RTK) satellite positioning which uses a base station to help reduce the errors associated with received signals from positioning satellites. Such differential/RTK methods for reducing these errors are well known. Using such methods, the position of antennas 201 and 202 may be determined with a high degree of horizontal accuracy (illustratively plus or minus 5 millimeters) and vertical accuracy (illustratively plus or minus 12-18 millimeters).

Determining the precise locations of antennas 201 and 202 allows accurate determination of the orientation of the body 101 of the excavator 100. For example, if one antenna is positioned lower than the other it would indicate that the body is tilted. Additionally, since the position of each antenna on the body of the excavator is known, determining the position of antenna 201 relative to the position of antenna 202 will provide an accurate measurement of the heading of body 101 of the excavator. Thus, using two antennas allows both tilt and heading measurements of the body 101. However, simply knowing the tilt and heading of the body 101 is not sufficient for high-precision excavation. Instead, the precise orientation of the bucket 105 and, more particularly, the precise position and orientation of the leading (or cutting) edge of the bucket must be known.

Prior attempts have relied on various methods for determining the position and orientation of the leading edge of the bucket to facilitate precise excavation. For example, in one such method, angle sensors have been placed on the boom, stick and bucket linkage. Such angle sensors are also referred to herein interchangeably as inclinometers. Thus, referring once again to FIG. 2, sensor 203 is placed on body 101, sensor 204 is mounted to boom 103, sensor 205 is mounted on stick 104, and sensor 206 is placed on bucket 105. These sensors are calibrated for a given position of the cutting edge and or prongs of the bucket 105. Thus, any angular movement of the sensor (i.e., movement of the associated portion) can be measured. The dimensions of the boom, stick and bucket are known, and the length from the positioning system antennas can be measured. Accordingly, for any angular change detected by sensors 203-206 in FIG. 2, the location of the cutting edge of bucket 105 can be geometrically calculated and excavation operations can be accurately performed in less time using fewer people than prior manual methods.

In another technique, satellite positioning antennas are mounted to the stick of an excavator. Such technique is described in copending U.S. patent application Ser. No. 11/108,013, filed Apr. 15, 2005, and titled Method and Apparatus for Satellite Positioning of Earth-Moving Equipment, which is incorporated by reference herein in its entirety. According to that technique, satellite inclinometers antennas are used to determine the position and orientation of the stick and, then by using geometric calculations with, for example, one or more angle sensors on the bucket, the precise location of a portion of an attachment of the excavator/backhoe, such as the prongs of a bucket, can be determined.

SUMMARY OF THE INVENTION

The present inventor has recognized that, while placing satellite antennas on the stick of an excavator is extremely advantageous and lowers cost, placing the antennas in such a position will subject those antennas to a wide range of motion. As a result of this wide range of motion, the orientation of the antennas may be such that the signal strength received from the positioning satellites by one or more of the antennas may fall below a threshold necessary for use in positioning calculations. In extreme cases, the signal may be lost entirely. As a result, critical real-time positioning calculations that are required during earthmoving operations may not be possible.

Therefore, the present inventor has invented a method and apparatus that allows the satellite antennas to be maintained in an orientation with respect to the positioning system satellites in a way such that the strongest signals can be received from the greatest number of satellites. In particular, the present inventor has invented an apparatus whereby a housing of a positioning antenna is mounted in a gimbaled fashion onto a vehicle, such as the aforementioned excavator. Such a gimbaled antenna maintains a horizontal orientation relative to a predetermined axis and, as a result, remains in a position to receive signals from positioning system satellites even during instances of high angular deflection of the antenna support, such as may occur during earth-moving operations.

These and other advantages of the invention will be apparent to those of ordinary skill in the art by reference to the following detailed description and the accompanying drawings.

DETAILED DESCRIPTION OF THE INVENTION

Figure 3:
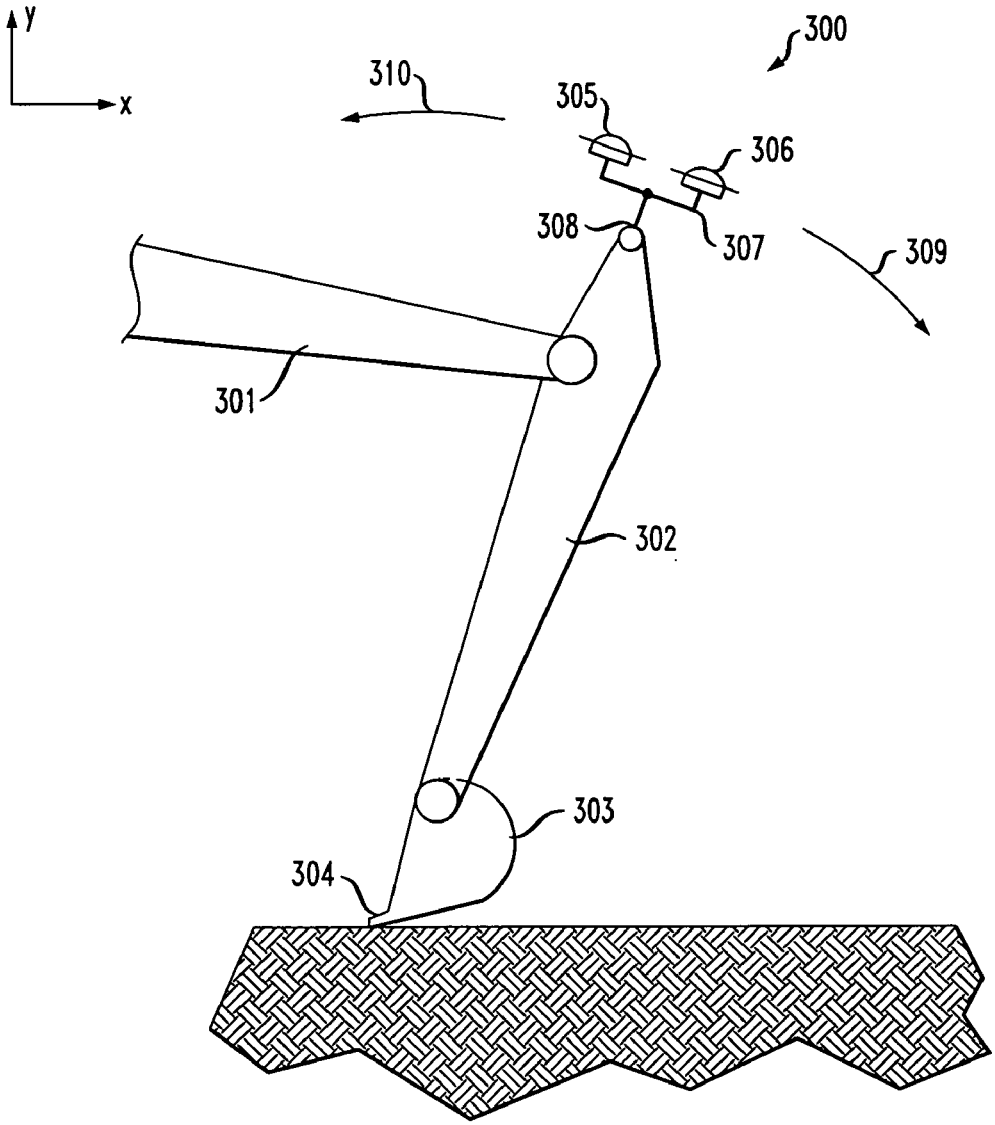
FIG. 3 shows another illustrative prior art excavator adapted to use a satellite positioning system.

FIG. 3 shows a boom, stick and bucket assembly of an illustrative excavator such as that described above. The boom and stick are also referred to herein as "load-bearing arms". Specifically, referring to FIG. 3, boom 301 is connected to stick 302 which is, in turn, attached to bucket 303, as discussed above. However, unlike the previously discussed excavators that utilized a satellite positioning system to assist in the control of the machine, the antennas 305 and 306 are mounted on support structure 307 which is attached to stick 302 at illustrative point 308. One skilled in the art will recognize that antennas 305 and 306 may be positioned in many different configurations. For example, the antennas may each be mounted separately on the stick. Additionally, while the antennas are shown mounted longitudinally along the stick, one skilled in the art will recognize that other mounting configurations are possible.

In the illustrative excavator of FIG. 3, in order to conduct excavation operations with a high degree of accuracy, it is necessary to know the position of bucket 303 with a high degree of accuracy and, more particularly, to know the position (e.g., the height/depth) of cutting teeth/prongs 304. As discussed above, some prior methods required knowledge of the dimensions of several excavator portions as well as multiple angle sensors to determine the location of prongs 304. More recently, however, as described above and disclosed in the 11/108,013 application, the precise determination of the position of the prongs 304 of bucket 303 can be determined by mounting the antennas directly on the stick, as shown in the illustrative embodiment of FIG. 3.

Figure 4:
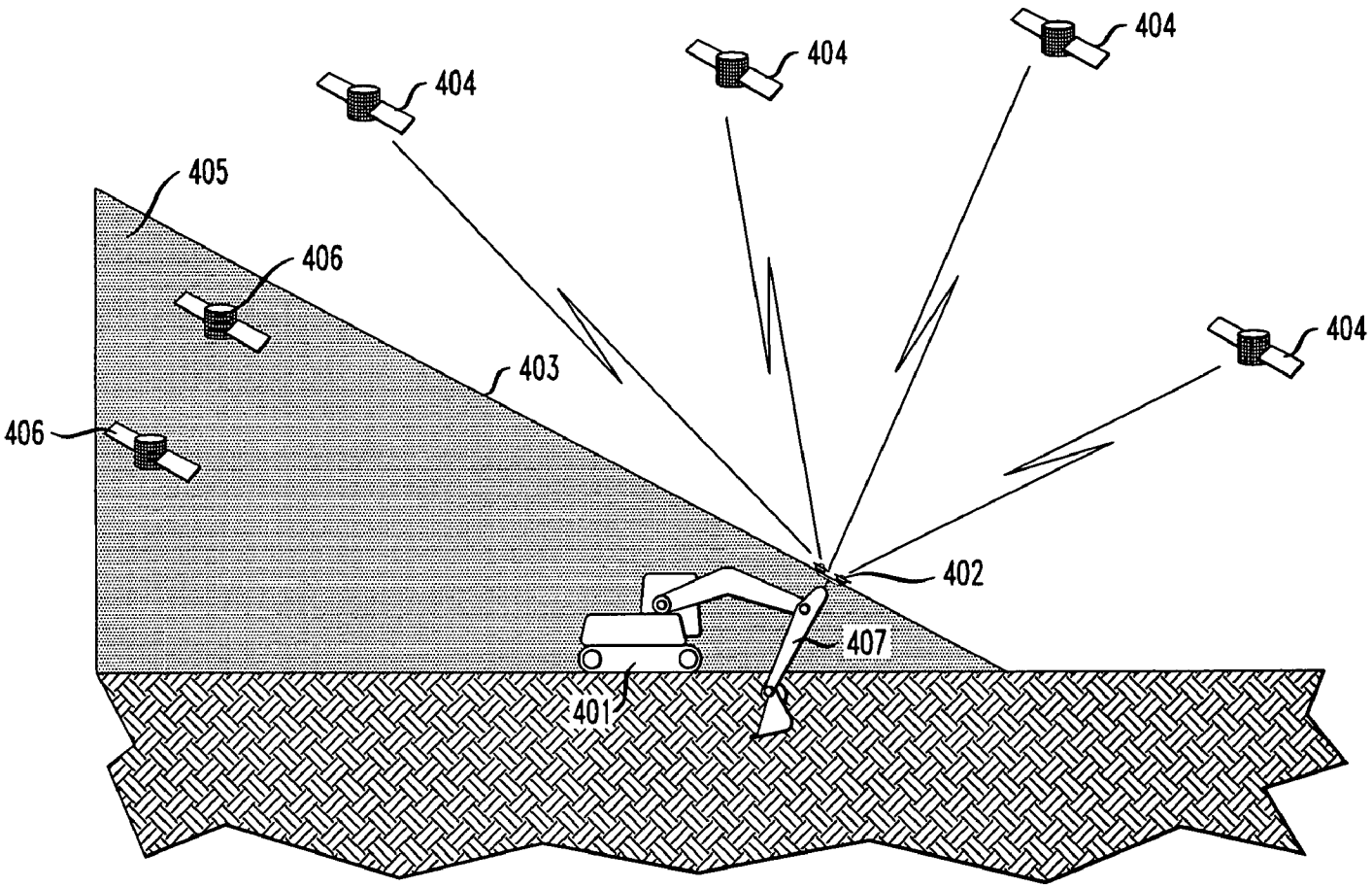
FIG. 4 shows how the illustrative excavator of FIG. 3 may result in satellites in a satellite positioning system being out of view of satellite positioning system receive antennas.

As one skilled in the art will recognize, antennas such as antennas 305 and 306 typically receive signals from a plurality of positioning system satellites such as those used in GPS or GLONASS systems. In many typical examples, the more satellites from which such antennas receive signals, the greater the potential accuracy of the calculated position of the antennas. However, the present inventors have recognized that, by mounting antennas, such as antennas 305 and 306 to the stick 302, those antennas may be moved during earth moving operations to an orientation in which they cannot receive satellite signals from a satellite positioning system. FIG. 4 shows such an orientation. Specifically, referring to that figure, excavator 401 which is, illustratively, conducting earth-moving operations, has stick 407 with antennas 402 attached to the stick. One skilled in the art will recognize that antennas such as illustrative antennas 402 typically are only capable of receiving a signal from certain directions. When a satellite is in certain positions relative to the antennas (i.e., below the field of view of the antenna), then the signal will not be of sufficient strength as received at a receiver connected to the antennas to permit reception of the signal. As shown in FIG. 4, antennas 402 are positioned in a way such that signals from satellites 404 are received with sufficient strength for positioning calculations while, on the other hand, satellites 406 are positioned relative to the antennas in a way such that the signals cannot be received with such sufficient strength to support positioning system calculations. As one skilled in the art will recognize, depending upon the relative positioning of satellites 404 and 406 with respect to the antennas 402, the number and strength of signals received by antennas 402 may be insufficient to permit accurate positioning calculations.

Therefore, in accordance with an embodiment of the present invention, the present inventors have recognized that satellite positioning system antennas, such as antennas 402 in FIG. 4, can be attached to the stick or other component of an earth moving machine to allow a greater number of satellites remain in view of the antennas, even when the position of the equipment upon which the antennas are mounted changes. More particularly, in accordance with a particular illustrative embodiment, antennas such as antennas 402 can be can be attached in a way such that the antennas are permitted to change their three-dimensional orientation with respect to the stick of the earthmoving machine. In this way, when the stick of the earthmoving machine moves, the antennas can remain positioned so that, for example, signals from all of satellites 404 and 406 in FIG. 4 are received with adequate strength to permit accurate positioning calculations.

Figure 5:
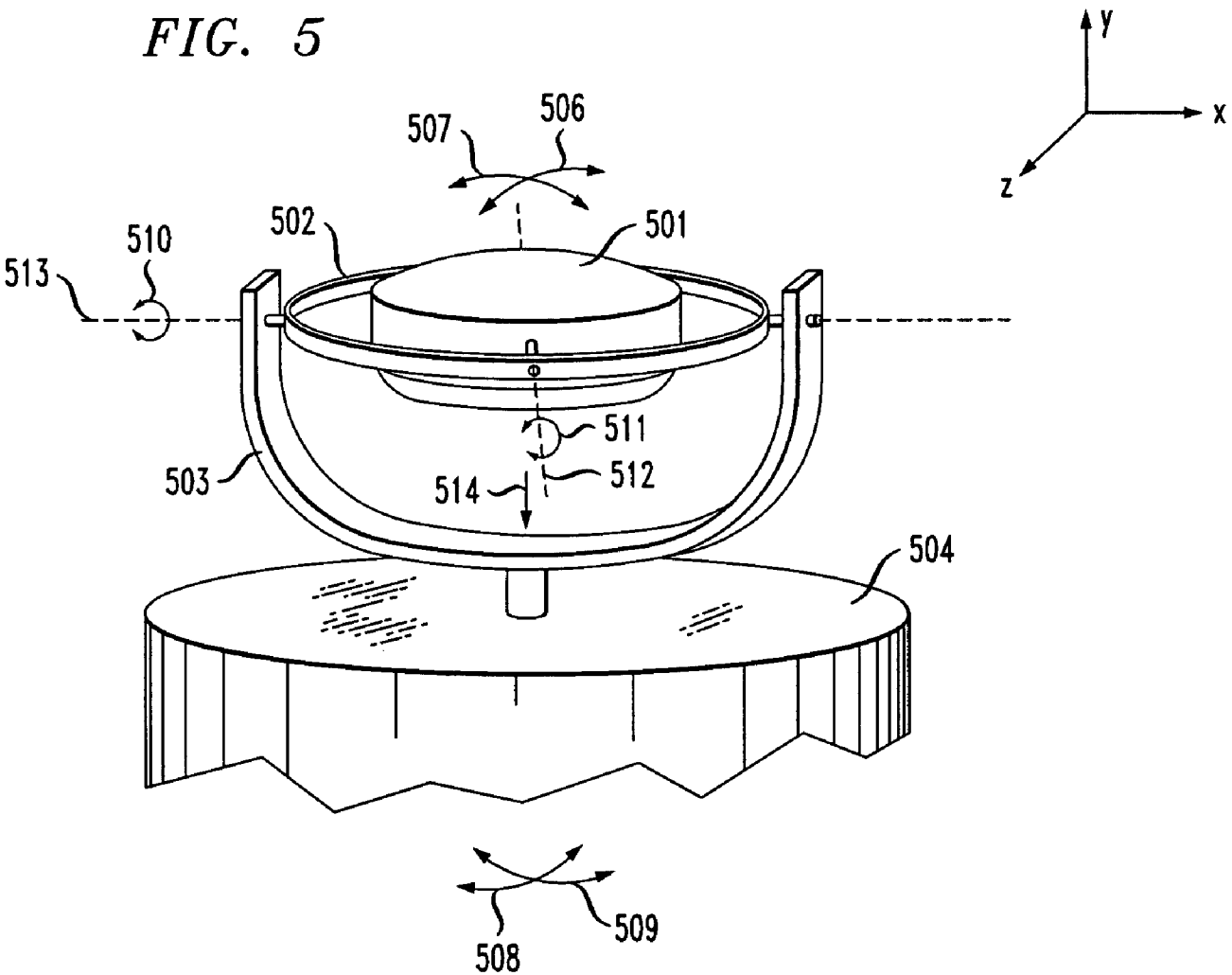
FIG. 5 shows a satellite positioning system antenna in accordance with an embodiment of the present invention.

FIG. 5 shows one illustrative embodiment of how an antenna housing, such as antenna housing 501 can be mounted to permit a change in orientation of the housing as the surface it is mounted on moves, as discussed above. Referring to that figure, antenna housing 501 is a housing containing, for example, a receiving antenna element of a positioning system antenna. Housing 501 is mounted in a gimbal structure consisting of support structure 503 and gimbal ring 502. Support structure 503 is, for example, mounted to surface 504 which is, illustratively, a surface of the stick of an earthmoving machine, such as stick 407 of excavator 401 of FIG. 4. Antenna housing 501 is illustratively mounted to gimbal ring 502 in a way such that the housing 501 can rotate in directions 511 about axis 512. Gimbal ring 502, in turn, is mounted to support structure 503 in a way such that the gimbal ring can rotate in directions 510 about axis 513. Accordingly, as one skilled in the art will recognize, when surface 504 moves in directions 508 and 509, as well as in the y-direction in FIG. 5, gravitational force in direction 514 acting on the antenna housing will cause the gimbal ring 502 and antenna housing 501 to rotate about axes 512 and 513 in a way such that the antenna housing will remain substantially horizontal, i.e., parallel with the x-z plane. One skilled in the art will recognize that the antenna of FIG. 5 is merely illustrative and that other variations are possible. For example, while the gimbaled antenna 501 of FIG. 5 is capable of maintaining the antenna in a horizontal orientation with respect to multiple axes (i.e., the x and z axes in FIG. 5), one skilled in the art will recognize that such a complex structure may not be necessary. More particularly, referring once again to FIG. 3, an antenna mounted to a stick of an excavator may experience a large range of motion in directions 309 and 310. However, the antennas will not typically experience large ranges of motion in other directions (e.g., a direction perpendicular to directions 309 and 310). Therefore, one skilled in the art will recognize that it may be desirable to mount antenna 501 of FIG. 5 to the stick in a way such that it is only capable of rotating to compensate for the movement in directions 309 and 310. While such a structure will not be able to fully compensate for the full range of motion of the excavator, such an arrangement would be satisfactory in many implementations.

Figure 6:
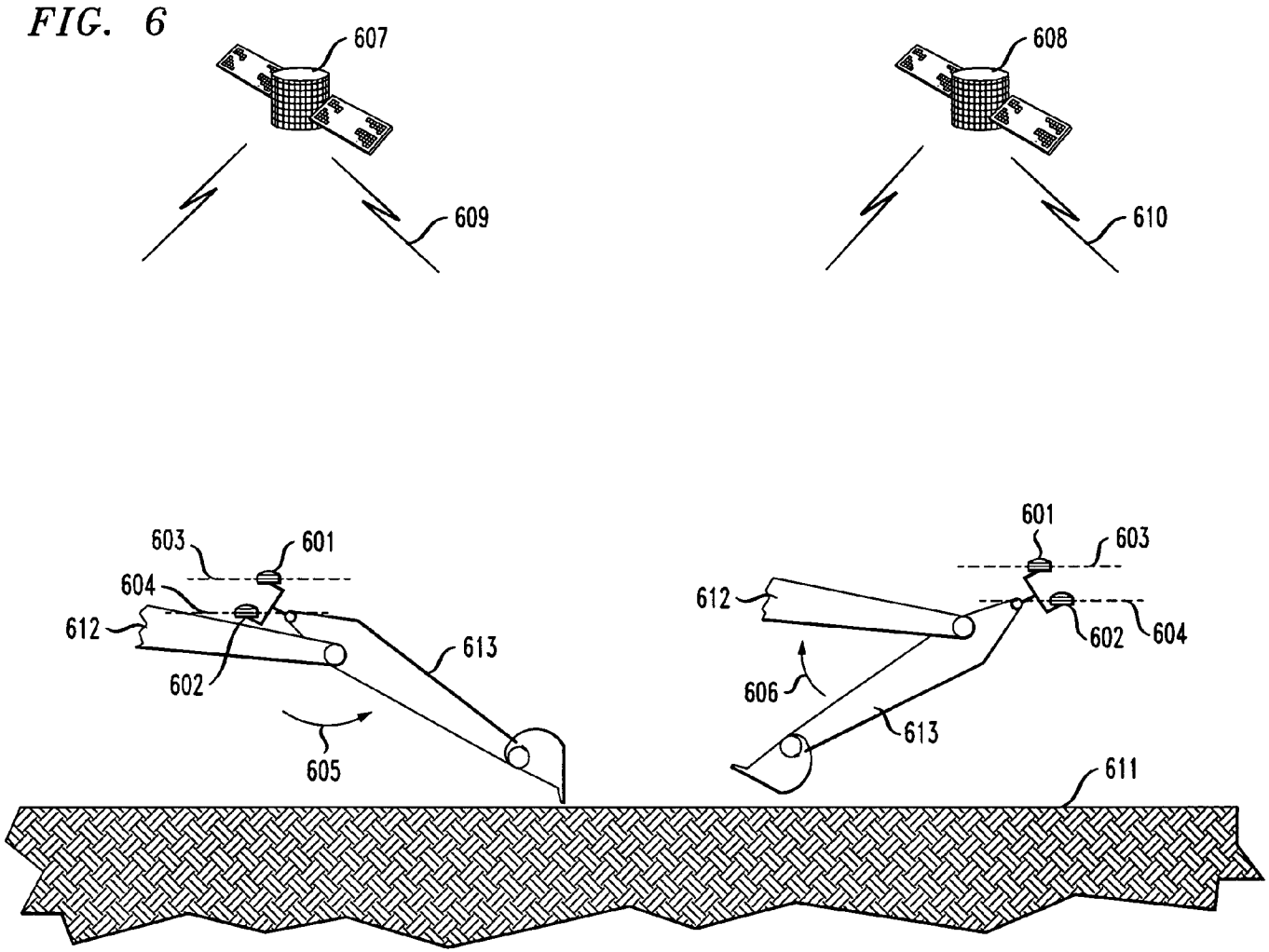
FIG. 6 shows how the antenna of FIG. 5 may be used in excavation operations in accordance with an embodiment of the present invention.

FIG. 6 shows one illustrative embodiment of how the gimbaled antenna structure of FIG. 5 can be used with the excavator of FIG. 3. Referring to FIG. 6, as described above in association with FIG. 3, antennas 601 and 602 are once again mounted on stick 613 which is, in turn, attached to boom 612. However, in the embodiment of FIG. 6, instead of the antennas being mounted in a fixed position, which causes the aforementioned potential loss of signal from positioning satellites, antennas 601 and 602 are mounted using the illustrative gimbal structure as described above in association with FIG. 5. Thus, for example, when stick 613 moves in direction 605, the antenna housings of antennas 601 and 602 remain oriented in horizontal positions 603 and 604 with respect to surface 611. Similarly, when the stick is moved in direction 606, the antenna housings will once again remain oriented in horizontal positions 603 and 604. Thus, illustratively, during both types of operations (i.e., when stick 613 is moved in direction 605 or in direction 606), both signals 609 and 610 from satellites 607 and 608, respectively, will continue to be received by antennas 601 and 602.

Figure 1:
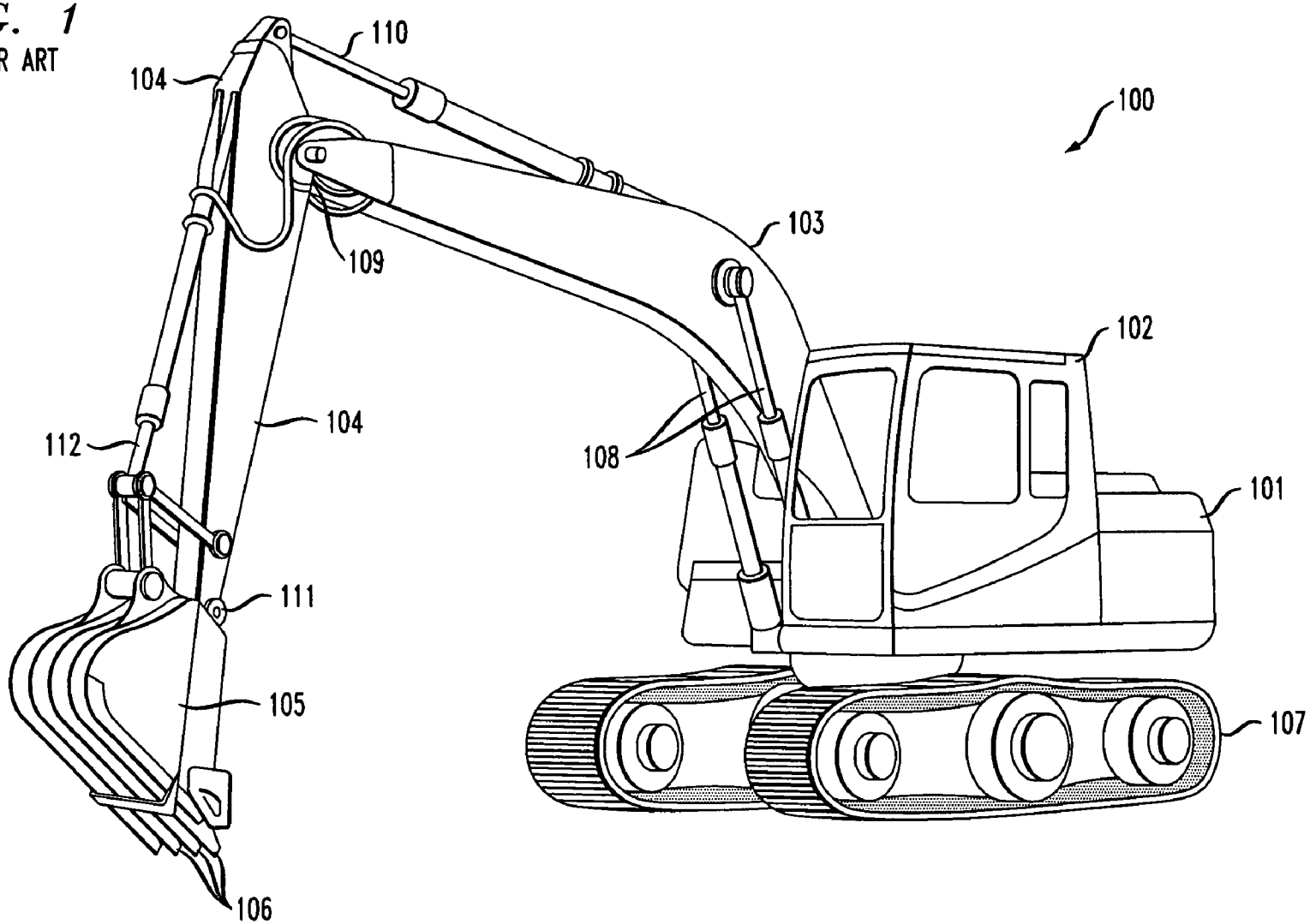
FIG. 1 PRIOR ART
FIG. 1 shows an illustrative prior art excavator.
Figure 2:
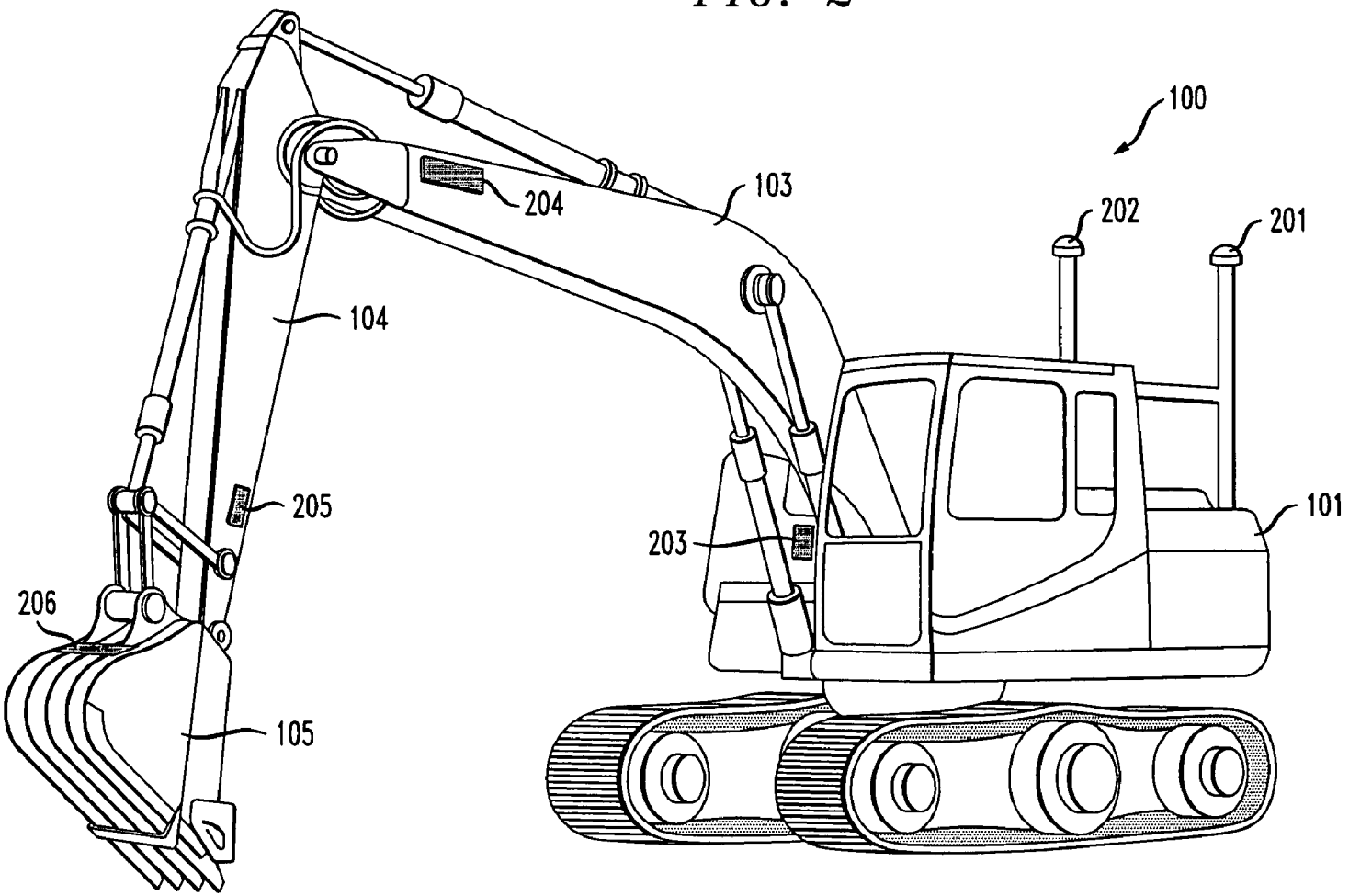
FIG. 2 shows an illustrative prior art excavator adapted to use a satellite positioning system.
Figure 7:
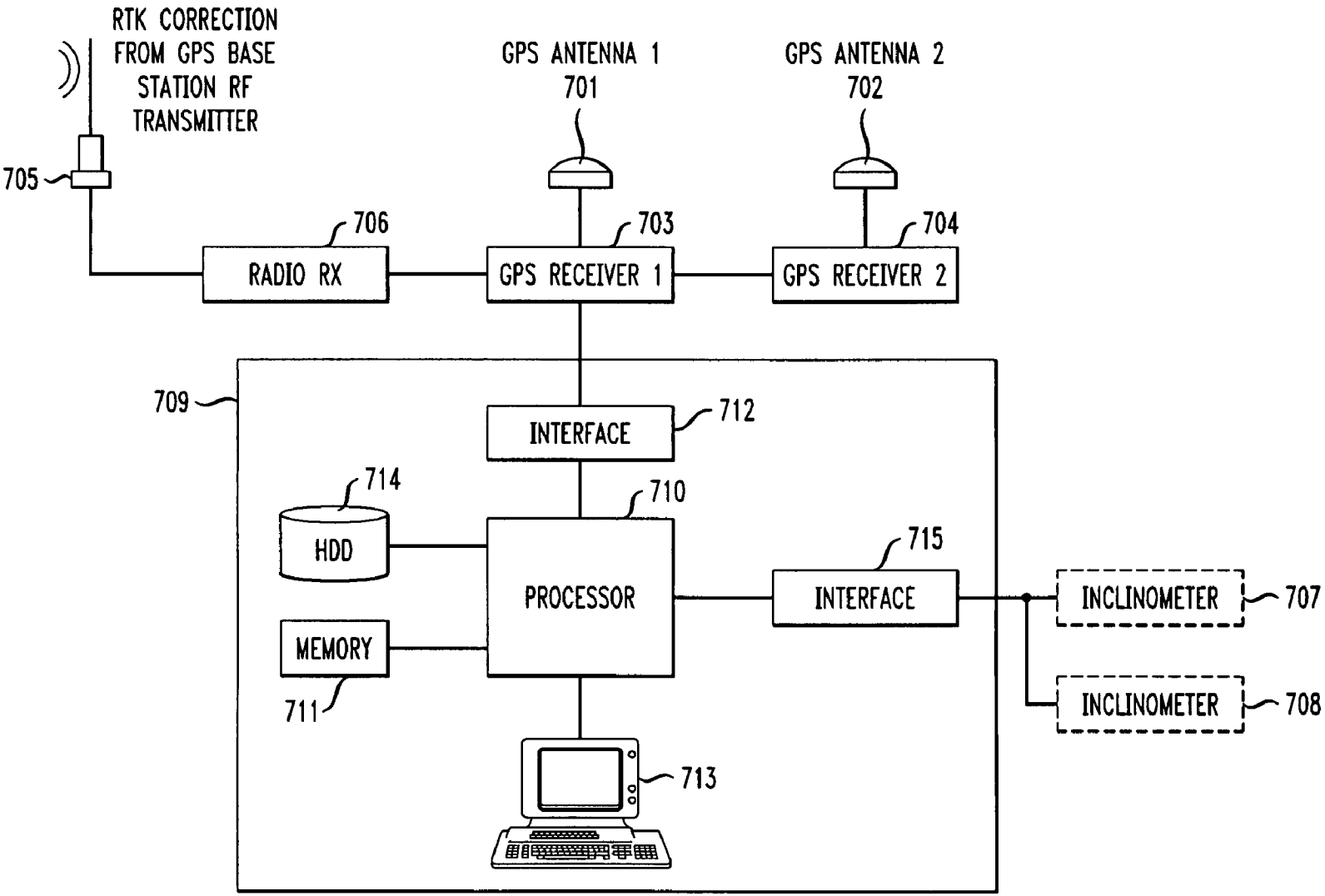
FIG. 7 shows an illustrative block diagram of a satellite positioning receiving system suitable for use with an excavator in accordance with the principles of the present invention.

FIG. 7 is a block diagram showing one illustrative embodiment of a satellite positioning system that may be used with the gimbaled positioning system antennas, as described above. Specifically, as discussed above, a plurality of satellite positioning system antennas, such as GPS positioning antennas 701 and 702, are positioned on the stick of an excavator, such as stick 104 in FIG. 1. Each of these antennas is connected to a corresponding receiver 703 and 704 which determine the precise position of each antenna 701 and 702. The position of each antenna may be more accurately obtained in the illustrative implementation of FIG. 7 by incorporating a correction signal obtained from a base station transmitter. As discussed above, the use of such a correction signal is typically referred to as "differential" positioning or as "real time kinematic" correction of positioning. The correction signal transmitted by the base station is received by a radio receiver 706 via antenna 705 and is used in the calculations of the positioning receivers 703 and 704 to obtain more accurate positions of antennas 701 and 702. Inclinometers/angle sensors 707 and 708 are used, as described illustratively above, to measure both the scoop of the bucket as well as the slope of the body of the excavator. These calculations are made and used in illustrative graphics computer 709 that is, for example, used by the excavator operator in controlling the excavation operations. Graphics computer 709 may be any suitable computer adapted to compute and/or display the position of the prongs and/or the bucket. Computer 709 may have, illustratively, a processor 710 (or multiple processors) which controls the overall operation of the computer 709. Such operation is defined by computer program instructions stored in a memory 711 and executed by processor 710. The memory 711 may be any type of computer readable medium, including without limitation electronic, magnetic, or optical media. Further, while one memory unit 711 is shown in FIG. 7, it is to be understood that memory unit 711 could comprise multiple memory units, with such memory units comprising any type of memory. Computer 709 also comprises interface 712 which provides for the transmission of antenna positional data associated with antennas 701 and 702 from GPS receivers 703 and 704 to computer 709. Computer 709 also illustratively comprises interface 715 adapted to receive slope and/or inclination data associated with the earthmoving machine/excavator or a component thereof. Although shown separately in FIG. 7, one skilled in the art will recognize that interface 712 may be the same interface as interface 715. Additionally, computer 709 also illustratively comprises one or more input/output devices, represented in FIG. 7 as I/O 713, for allowing interaction, for example, with an excavator operator or technician. Finally, computer 709 also illustratively comprises a storage medium, such as a computer hard disk drive 714 for storing, for example, data and computer programs adapted for use in accordance with the principles of the present invention as described hereinabove. One skilled in the art will recognize that computer 709 is merely illustrative in nature and that various hardware and software components may be adapted for equally advantageous use in a computer in accordance with the principles of the present invention.

The foregoing Detailed Description is to be understood as being in every respect illustrative and exemplary, but not restrictive, and the scope of the invention disclosed herein is not to be determined from the Detailed Description, but rather from the claims as interpreted according to the full breadth permitted by the patent laws. It is to be understood that the embodiments shown and described herein are only illustrative of the principles of the present invention and that various modifications may be implemented by those skilled in the art without departing from the scope and spirit of the invention. For example, while the above described embodiments involve an excavator, one skilled in the art will recognize that the principles described therein are equally applicable to other machines such as, for example, a backhoe. Typically backhoes differ from excavators in that the booms of backhoes are mounted in a way such that the boom can rotate about a pivot point relative to the body of the machines. Thus, while the body of the machine stays in one position, the boom rotates to move the bucket or other tool. The body and boom of excavators, on the other hand, are typically connected in a fixed manner such that the body and boom always have the same heading. In order to change the direction of the bucket, it is necessary to rotate the entire body of the excavator about a base. One skilled in the art will fully appreciate how the above described aspects of the embodiments of the present invention may be modified for use with such backhoes and other vehicles, such as dozers.

The invention claimed is:

1. Apparatus for use with a satellite positioning system comprising:

first and second gimbal structures attached to a surface;

a first satellite positioning system receiving antenna attached to said first gimbal structure;

a second satellite positioning system receiving antenna attached to said second gimbal structure;

at least one receiver configured to determine a position of the first antenna and a position of the second antenna; and a processor configured to determine a third position of the surface based on the position of the first antenna and the position of the second antenna.

2. The apparatus of claim 1 wherein said surface is a surface of a vehicle.

3. The apparatus of claim 2 wherein said vehicle is an excavator and said surface is a surface of a stick of said excavator.

4. The apparatus of claim 1 wherein said at least one receiver is disposed in an antenna housing.

5. The apparatus of claim 1 wherein the first satellite positioning system receiving antenna is attached to said first gimbal structure in a horizontal orientation relative to a first predetermined axis, and the second satellite positioning system receiving antenna is attached to said second gimbal structure in a horizontal orientation relative to a second predetermined axis.

6. An earthmoving machine comprising:

a moveable arm attached to a body of said earthmoving machine;

first and second gimbal structures attached to the moveable arm;

a first satellite positioning system receiving antenna attached to said first gimbal structure;

a second satellite positioning system receiving antenna attached to said second gimbal structure;

at least one receiver configured to determine a position of the first antenna and a position of the second antenna; and a processor configured to determine a third position of the earthmoving machine based on the position of the first antenna and the position of the second antenna.

7. The earthmoving machine of claim 6 wherein said moveable arm comprises a boom of said earthmoving machine.

8. The earthmoving machine of claim 6 wherein said moveable arm comprises a stick of said earthmoving machine.

9. The earthmoving machine of claim 6 wherein said earthmoving machine comprises an excavator.

10. The earthmoving machine of claim 6 wherein the first satellite positioning system receiving antenna is attached to said first gimbal structure in a horizontal orientation relative to a first predetermined axis, and the second satellite positioning system receiving antenna is attached to said second gimbal structure in a horizontal orientation relative to a second predetermined axis.

11. The earthmoving machine of claim 6 wherein said at least one receiver is disposed in an antenna housing.

* * * * *